US010618798B2

(12) United States Patent
Schweble et al.

(10) Patent No.: US 10,618,798 B2
(45) Date of Patent: Apr. 14, 2020

(54) APPARATUS FOR EMPTYING A FLUID CONTAINER AND METHOD FOR COUPLING A FLUID CONTAINER TO A CORRESPONDING APPARATUS

(71) Applicants: Ecolab USA Inc., Saint Paul, MN (US); Martin Schweble, Siegsdorf (DE); Massoud Nahidino, Traunstein (DE)

(72) Inventors: Martin Schweble, Siegsdorf (DE); Massoud Nahidino, Traunstein (DE)

(73) Assignee: Ecolab USA Inc., Saint Paul, MN (US)

( * ) Notice: Subject to any disclaimer, the term of this patent is extended or adjusted under 35 U.S.C. 154(b) by 0 days.

(21) Appl. No.: 15/117,841

(22) PCT Filed: Feb. 10, 2014

(86) PCT No.: PCT/EP2014/052534
§ 371 (c)(1),
(2) Date: Aug. 10, 2016

(87) PCT Pub. No.: WO2015/117679
PCT Pub. Date: Aug. 13, 2015

(65) Prior Publication Data
US 2017/0008754 A1 Jan. 12, 2017

(51) Int. Cl.
*B67D 1/00* (2006.01)
*B67D 7/34* (2010.01)
*B67D 7/32* (2010.01)

(52) U.S. Cl.
CPC ..... *B67D 7/346* (2013.01); *B67D 7/3272* (2013.01)

(58) Field of Classification Search
CPC .. B67D 1/0041; B67D 1/0888; B67D 1/0878; B67D 1/0882; B67D 7/344; B67D 7/346; B67D 7/348; B67D 7/3272; G06F 17/00
(Continued)

(56) References Cited

U.S. PATENT DOCUMENTS 5,601,413 A * 2/1997 Langley ..... F04B 49/02 222/63
5,803,317 A * 9/1998 Wheeler ..... B67D 1/0004 222/105
(Continued)

FOREIGN PATENT DOCUMENTS

AT 512688 A1 10/2013
CN 103083750 A 5/2013
(Continued)

OTHER PUBLICATIONS

International Patent Application No. PCT/EP2014/052534, International Search Report and Written Opinion dated Oct. 15, 2014, 10 pages.

*Primary Examiner* — Charles Cheyney
(74) *Attorney, Agent, or Firm* — Fredrikson & Byron, P.A.

(57) ABSTRACT

The invention relates to an apparatus (12) for emptying a fluid container (10), wherein the apparatus (12) comprises: —a pumping unit (20) configured to pump fluids, —a display device (22); —a data input unit comprising •a read-out device (26) configured to read out fluid type identifying data from at least one marking element (14) of the fluid container (10) and/or •input means (24) configured for a manual input of the fluid type identifying data and/or for choosing the fluid type identifying data manually from a list of reference data displayed on the display device (22); and —an identification unit configured to perform a data comparison of the fluid type identifying data with the reference data for identifying the fluid (18) inside the fluid container (10); wherein the apparatus (12) is configured to display fluid type information about the identified fluid type of the fluid in the fluid container (10) on the display device (22). The invention further relates to a corresponding
(Continued)

Figure 1:
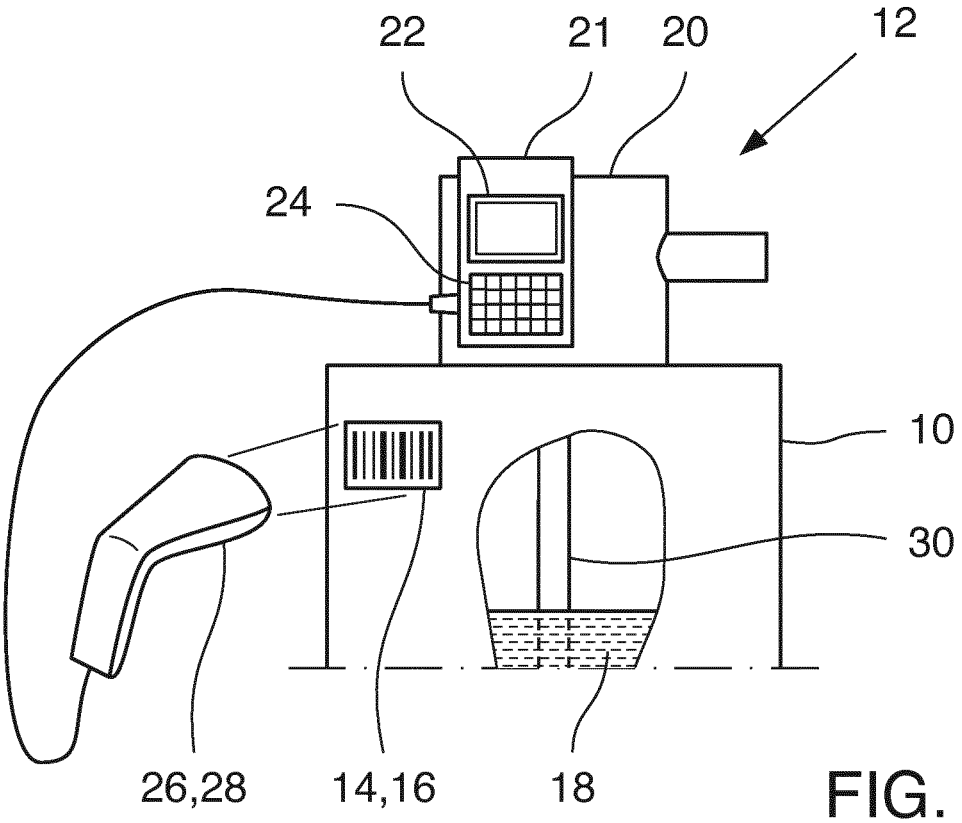

method for coupling a fluid container (10) to an apparatus (12) for emptying said fluid container (10).

20 Claims, 1 Drawing Sheet

(58) Field of Classification Search
USPC ..... 222/333, 23–52, 129.1, 144.5, 129.3; 700/244, 239, 281
See application file for complete search history.

(56) References Cited

U.S. PATENT DOCUMENTS 6,148,838 A * 11/2000 Tsay ..... B67D 1/0871 137/2
6,879,876 B2 * 4/2005 O'Dougherty ..... B67D 7/0283 700/231
7,237,577 B1 * 7/2007 Yacko ..... B67D 7/346 141/94
7,747,344 B2 * 6/2010 O'Dougherty ..... B67D 7/0283 700/231
8,240,508 B2 * 8/2012 Wegelin ..... B67D 1/0078 222/52
8,464,499 B2 * 6/2013 Asp ..... B65C 7/00 53/410
9,162,863 B2 * 10/2015 Till ..... B67D 1/0884
2003/0135388 A1 7/2003 Martucci et al.
2007/0044820 A1 3/2007 Chan et al.
2007/0128048 A1 6/2007 Gonnella et al.
2009/0069947 A1 * 3/2009 Newman ..... B67D 1/0021 700/281
2010/0024915 A1 2/2010 Thomas et al.
2010/0089943 A1 * 4/2010 Till ..... B67D 1/0884 222/1
2010/0146587 A1 6/2010 Sholes et al.
2010/0312401 A1 12/2010 Gutierrez et al.
2011/0000923 A1 1/2011 Morales
2011/0082595 A1 4/2011 Mehus et al.
2011/0084843 A1 * 4/2011 Liu ..... B67D 3/0077 340/603
2012/0160868 A1 * 6/2012 Pallante ..... B05C 11/10 222/1
2014/0136366 A1 * 5/2014 Carroll ..... G06Q 30/0635 705/26.8
2017/0289824 A1 10/2017 Figoli et al.

FOREIGN PATENT DOCUMENTS

DE 29902967 U1 6/1999
JP S60148497 A 8/1985
JP S63162470 A 7/1988
JP 2005178899 A 7/2005
JP 2006107075 A 4/2006
WO 2006110714 A2 10/2006
WO 2012117413 A1 9/2012

* cited by examiner

APPARATUS FOR EMPTYING A FLUID CONTAINER AND METHOD FOR COUPLING A FLUID CONTAINER TO A CORRESPONDING APPARATUS

RELATED APPLICATIONS

This application is a 35 U.S.C. 371 national stage filing from International Application No. PCT/EP2014/052534, filed Feb. 10, 2014, the entire contents of which are incorporated herein by reference.

FIELD OF THE INVENTION

The invention relates to an apparatus for emptying a fluid container, wherein the apparatus comprises a pumping unit configured to pump fluids, and a display device.

The invention further relates to a corresponding method for coupling a fluid container to an apparatus for emptying said fluid container.

BACKGROUND OF THE INVENTION

The above mentioned apparatus for emptying a fluid container is known, e.g., as an apparatus for fluid delivery from said fluid container. Some of these apparatuses comprise controller modules with display devices for displaying additional information concerning the pumping unit like rotational speed, working hours, etc.

When exchanging the empty fluid container, it is necessary to ensure that the new fluid container contains the desired fluid. In some systems this is realized by a fluid type specific coupling system for coupling the fluid container to the apparatus. These kinds of coupling systems sometimes are undesired for various reasons.

Therefore, the object underlying the present invention is to provide alternative measures ensuring that the newly coupled fluid container contains the desired fluid.

SUMMARY OF THE INVENTION

This object is achieved by the invention as defined by the independent claims. The dependent claims detail advantageous embodiments of the invention.

According to various aspects of the invention, the apparatus for emptying a fluid container comprises: (i) a pumping unit configured to pump fluids; (ii) a display device; (iii) a data input unit comprising a read-out device configured to read out fluid type identifying data from at least one marking element of the fluid container automatically and/or input means configured for a manual input of said fluid type identifying data and/or for choosing these fluid type identifying data from a list of reference data displayed on the display device; (iv) an identification unit configured to perform a data comparison of the fluid type identifying data with the reference data for identifying the fluid inside the fluid container. The apparatus is configured to display fluid type information about the identified fluid type of the fluid in the fluid container on the display device. The displayed fluid type information enables the user to check at a glance, which type of fluid is provided by the fluid container coupled to that apparatus. The fluid type identifying data can be part of the displayed fluid type information.

The marking element contains the fluid type identifying data for identifying the fluid inside the container or—to be more generally—the fluid the container is intended for. The marking element can be a marking label on the outer shell of the fluid container. The fluid can be any kind of liquid, aerosol, etc. Preferably, the fluid is an industrial manufactured product for disinfection and/or cleaning in liquid form.

According to a preferred embodiment of the present invention, the apparatus is configured to await a manual confirmation entry via the input means in order to start the emptying process. In other words, the user of the apparatus has to confirm the fluid type information displayed on the display device of the apparatus manually.

In accordance with another aspect of the present invention, the identification unit is configured to perform a data comparison of the current data input of fluid type identifying data with the fluid type identifying data of the fluid container previously coupled to the apparatus. In addition to the storage of the reference data list, the apparatus stores the fluid type identifying data of the fluid container previously coupled to the apparatus. The apparatus is preferably configured to release a signal in case the currently identified fluid type differs from the fluid type of the fluid in the fluid container previously coupled to the apparatus. According to another preferred embodiment of the present invention, the read-out device is a bar code scanner or a QR code scanner (QR: quick response) or a scanner for OCR (Optical Character Recognition) or an RFID chip reader (RFID: radio-frequency identification). The corresponding marking element of the fluid container is a bar code label, a QR code label or a graphic character label or an RFID chip.

According to another preferred embodiment of the present invention, the apparatus further comprises a controller module for controlling the pumping unit, which controller module comprises a data processor, the display device and/or the data input unit.

Preferably, the read-out device is coupled to the controller unit by means of wired data connection and/or wireless data connection. The wired date connection can, e.g., be a bus connection, especially a USB connection (USB: Universal Serial Bus). The wireless connection can, e.g., be a Bluetooth connection.

In accordance with another aspect of the present invention, the data input unit, especially the read-out device, is provided by a cellular phone. In other words, the cellular phone is integrated into the system of said apparatus. Commonly, a cellular phone comprises inter alia a display device, a data input unit comprising input means and a camera. In most cases the read-out device of such a cellular phone is the camera of said cellular phone. The cellular phone preferably is a Smartphone.

According to yet another preferred embodiment of the present invention, the apparatus further comprises a sensor module coupleable to the fluid container and configured to measure a filling level of the fluid container when coupled to the fluid container. The display device of the apparatus is configured to display the filling level as well.

In accordance with yet another aspect of the present invention, the apparatus for emptying a fluid container is configured to check whether the pumping unit is qualified for the identified fluid type. Most kinds of pumping units are configured to pump certain kinds of fluids only and are improper for other kind of fluids, due to the materials used in said pumping unit. Preferably, the identification unit is configured to perform a data comparison of the fluid type identifying data with reference data from a list of fluid types the pumping unit is qualified for.

The apparatus is preferably configured to release an alarm signal in case the pumping unit is unqualified for pumping fluid of the identified fluid type.

According to another preferred embodiment of the present invention, the apparatus further comprises a suction lance, which is fluid-technical coupled to the pumping unit. The suction lance of the apparatus being coupled to the fluid container is protruding into said fluid container.

The present invention further refers to a method for coupling a fluid container to an apparatus for emptying said fluid container, the method comprising the following steps: (a) performing a read out/input of the fluid type identifying data from the at least one marking element of the fluid container; (b) identifying the fluid by performing a data comparison of the fluid type identifying data with reference data; and (c) displaying fluid type information about the identified fluid type of the fluid in the fluid container. The displayed fluid type information enables the user to check at a glance, which type of fluid is provided by the fluid container coupled to that apparatus.

According to a preferred embodiment of the present invention, the method is performed by use of the aforementioned apparatus, wherein (a) the read-out/input step is performed by means of the read-out device or input means; (b) the identifying step is performed by means of the identification unit; and (c) the displaying step is performed by means of the display device.

According to another preferred embodiment of the present invention, the method comprises the further step (d) of confirming the displayed fluid type information subsequent to the displaying step (c) to start the pumping process.

According to another preferred embodiment of the present invention, the method comprises the further step (e) of performing data comparison of the current data input of fluid type identifying data with the fluid type identifying data of the fluid container previously coupled to said apparatus.

According to yet another preferred embodiment of the present invention, the method comprises the further steps of checking whether the pumping unit is qualified for pumping the identified fluid type, and pumping the fluid when the pumping unit is qualified only.

DETAILED DESCRIPTION OF THE INVENTION

Figure 2:
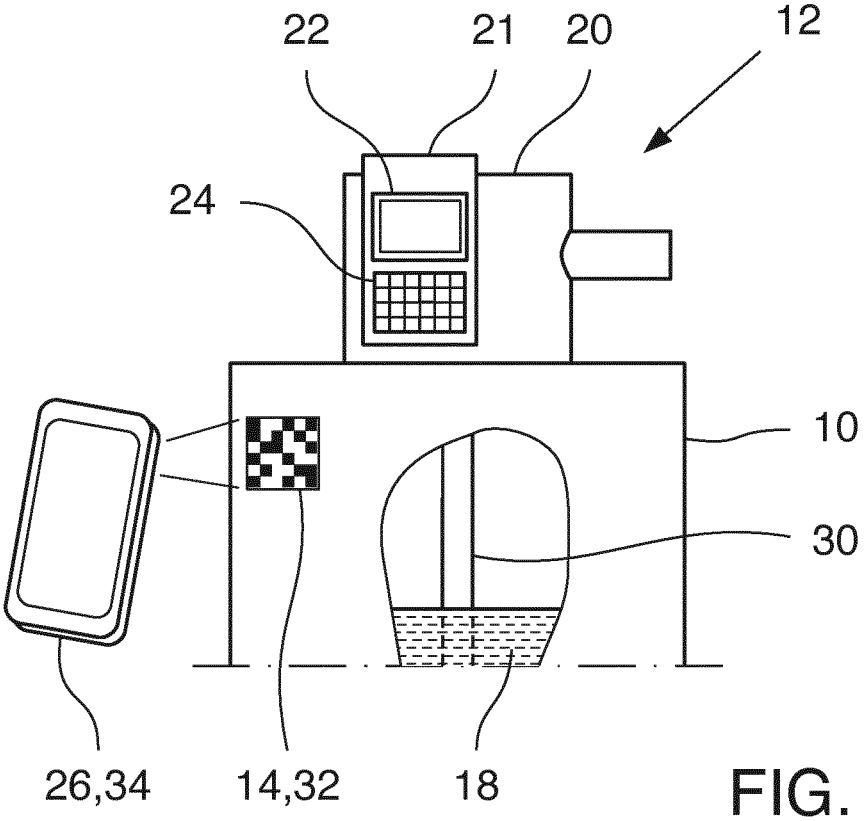

Additional details, features, characteristics and advantages of the object of the invention are disclosed in the figures and the following description of the respective figures, which—in exemplary fashion—show one embodiment and an example of a dispensing system according to the invention. In the drawings:

FIG. 1 shows a schematic illustration of a fluid container and an apparatus for emptying said fluid container according to a first preferred embodiment of the present invention; and FIG. 2 shows a schematic illustration of a fluid container and an apparatus for emptying said fluid container according to a second preferred embodiment of the present invention.

The illustration in FIG. 1 shows a fluid container 10 and an apparatus 12 for emptying the fluid container, which apparatus 12 is coupled to the top of the fluid container 10. The container 10 comprises a marking element 14 being a bar code label 16. The bar code printed on the label 16 contains fluid type identifying data characterizing the fluid 18 inside the fluid container 10 or at least the fluid the container is intended for. The apparatus 12 is an apparatus for fluid delivery from said fluid container 10. Said apparatus 12 comprises a pumping unit 20 configured to pump certain kinds of fluids 18. To be more precise, the pumping unit 20 is a dosing pump unit. The apparatus 12 further comprises a controller module 21 for controlling the pumping unit 20, which controller module 21 comprises a data processor (not shown), a storage device (not shown), a display device 22 and a data input unit with input means 24. The input means 24 in the example are keys of a key panel. These input means 24 are configured for a manual input of said fluid type identifying data and/or for choosing these fluid type identifying data from a list of reference data displayed on the display device 22. The apparatus 12 further comprises a read-out device 26 configured to read out fluid type identifying data directly from the marking element 14 of the fluid container. The read-out device 26 of the shown example is a bar code scanner 28, to be precise, a hand held bar code scanner 28. The read-out device 26 is coupled to the pumping unit 20 by means of wired USB data connection.

The apparatus 12 further comprises an identification unit provided by the data processor and a data storage device (not shown) of the controller unit 21. The identification unit is configured to perform a data comparison of the fluid type identifying data with the reference data listed in the list. The controller unit 21 is configured to display the fluid type information about the identified fluid type (of the fluid in the fluid container 10) on the display device 22. The apparatus 12 is configured to await a manual confirmation entry via the input means 24 in order to start the emptying process.

Further on, the apparatus 12 is configured to check whether the pumping unit 20 is qualified for pumping the fluid encased in the fluid container 10. The apparatus 12 further comprises a suction lance 30 protruding into the fluid container 10.

Coupling a (new) fluid container 10 to the aforementioned apparatus 12 can be performed by the following steps:

- performing an automatic read out and input of the fluid type identifying data from the at least one marking element 14 of the fluid container 10 by means of the read-out device 26 or performing a manual input of the fluid type identifying data from the at least one marking element 14 of the fluid container 10 by means of the input means 24;
- identifying the fluid type of the fluid 18 by performing a data comparison of the fluid type identifying data with the reference data by use of the identification unit; and
- displaying fluid type information about the identified fluid type of the fluid 18 in the fluid container 10 by use of the display unit 22.

The displayed fluid type information enables the user of the apparatus 12 to check "at a glance", which type of fluid 18 is provided by the fluid container 10 coupled to that apparatus 12.

In an optional confirming step subsequent to the displaying step, the user has to confirm the displayed fluid type information to start the pumping process.

In an optional comparison step, the identification unit performs a data comparison of the current data input of fluid type identifying data with the fluid type identifying data of the fluid container 10 previously coupled to this apparatus 12.

In an optional checking step, the apparatus 10 checks whether the pumping unit 20 is qualified for pumping fluids 18 of the identified fluid type. Afterwards, the pumping process is started automatically, if the pumping unit 20 is qualified for the identified fluid type.

FIG. 2 shows the fluid container 10 together with another fluid container emptying apparatus 12 coupled to the fluid container 10. The marking element 14 of the fluid container 10 shown in FIG. 2 is a QR code label 32. In this system, the read-out device 26 is provided by a cellular phone 34, or more precisely a Smartphone. In other words, the system of the apparatus 12 comprises said cellular phone/smartphone 34, which includes the read-out device 26 of the apparatus 12. In this case, the read-out device 26 is a camera (not shown) included in said phone 34. The read-out device 26 is coupled to the pumping unit 20 by means of wireless Bluetooth data connection.

In several embodiments, the apparatus 12 further comprises a sensor module (not shown) configured to measure a filling level of the fluid container 10 when coupled to the fluid container 10. The display device 22 is configured to display the filling level, which results in the following safety levels:

Level 1—visually with fluid type information (e.g. fluid name):

After setup with a fluid container 10 and corresponding fluid type information, display device 22 always shows the fluid type information.

After "empty detection", the user is informed that he has to replace the fluid container 10 (e.g. barrel) with the marking element 14 comprising the fluid type identifying data which correspond to the fluid type information displayed on the display device 22.

After replacing the fluid container, the user has to confirm at the apparatus 12, that he has carried out the replacement with the right fluid type (comparing the fluid type information/fluid type identifying data visually).

Level 2—visually with i.e. a SmartPhone 34 and fluid type identifying data (e.g. label information)

After setup with a fluid container 10, the display device 22 always shows the corresponding fluid type information.

After "empty detection", the display device 22 shows beneath the fluid type information additional information like a GTIN-13-Code (QR-Code) corresponding to the adjusted fluid type (the additional information might be the pH value, viscosity arid other relevant parameters stored in the pump).

After replacing the fluid container 10, the user has to scan the fluid type identifying data (e.g. GTIN-13-Code or QR-Code) of the marking element of the fluid container 10.

Then the user has to scan the fluid type identifying data (e.g. GTIN-13-Code or QR-Code) which is shown on the display. A Mobil App running on the SmartPhone compares the information of both GTIN-13-Code or QR Code and gives "green light" for identical fluid types, "yellow light" for similar fluid types and "red light" for different fluid types. Of course the scan sequence could be vice versa.

Then the user has to confirm manually at the apparatus 12 the replacement of the fluid container 10. Requirement for level 2 is equipment (i.e. a SmartPhone) with adequate software for scanning and comparing.

Level 3—automatically with connected read-out device (26) like, e.g., a scanner:

After setup with a fluid container, the display device 22 always shows the fluid type information (like e.g. the fluid name).

After empty detection, the display device shows beneeth the fluid type information a message that the user has to connect the scanner to the USB port of the apparatus 12.

After replacing the fluid container 12, the user has to read out the marking element 14 (e.g. GTIN-13-Code, QR-Code) printed on the label of the fluid container 12 with the camera).

After transmitting the data from the read-out device 26 to the apparatus 12, the software of the apparatus 12 compares the fluid type identifying data (GTIN-13-Code, QR-Code) with the reference data from the list of reference data and gives green for identical fluids 18, yellow for similar fluids 18 and red for different fluids 18.

When not green, the user he has to confirm manually at the apparatus that the pumping unit has to work with scanned fluid.

It should be noted that, as used in this specification and the appended claims, the singular forms "a", "an" and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

What is claimed is:

1. A method of coupling an apparatus for emptying a fluid container, wherein the apparatus comprises:

a pumping unit qualified to pump only certain types of fluids based on materials used to form the pumping unit;

an identification unit having storage that includes reference data corresponding to a plurality of fluid types identifiable by the identification unit and fluid type identifying data of fluid containers previously coupled to the apparatus, the reference data further including a list of fluid types the pumping unit is qualified for pumping; and a data input unit providing a current output of fluid type identifying data of the fluid container;

the method comprising:

receiving the current output of fluid type identifying data of the fluid container from the data input unit;

comparing, via the identification unit, the fluid type identifying data of the fluid container to the reference data to identify a fluid type of a fluid inside the fluid container;

identifying, via the identification unit:

a currently identified fluid type corresponding to the fluid type of the fluid inside the fluid container currently coupled to the apparatus, the currently identified fluid type being identified based on the comparison and fluid types of the fluid inside the fluid containers previously coupled to the apparatus;

determining if the pumping unit is qualified for pumping the currently identified fluid type by comparing the currently identified fluid type to:

the list of fluid types the pumping unit is qualified for pumping;

the fluid types of the fluid inside the fluid containers previously coupled to the apparatus; or both the list of fluid types the pumping unit is qualified for pumping and the fluid types of the fluid inside the fluid containers previously coupled to the apparatus;

providing a signal of one of a number of indications when the currently identified fluid type differs from the fluid types of the fluid inside the fluid containers previously coupled to the apparatus, wherein the signal indicates how significantly the currently identified fluid type differs from the fluid types of the fluid inside the fluid containers previously coupled to the apparatus;

performing a pumping process via the pumping unit if the pumping unit is qualified for pumping the currently identified fluid type; and not performing the pumping process via the pumping unit if the pumping unit is not qualified for pumping the currently identified fluid type.

2. The method according to claim 1, further comprising awaiting a manual confirmation entry via an input section of the apparatus in order to start the pumping process.

3. The method according to claim 1, wherein the data input unit is a bar code scanner or a QR code scanner or a scanner for OCR or a RFID chip reader.

4. The method according to claim 1, wherein the apparatus comprises a controller module for controlling the pumping unit, which controller module comprises a data processor, a display device and/or the data input unit, and wherein the controller module is in communication with the identification unit.

5. The method according to claim 1, wherein the data input unit is provided by a cellular phone.

6. The method according to claim 1, further comprising measuring a filling level of the fluid container when the apparatus is coupled to the fluid container.

7. The method according to claim 1, wherein the determining step is performed by the identification unit.

8. The method according to claim 1, wherein the pumping process is performed via a suction lance coupled to the pumping unit.

9. A method for coupling a fluid container to an apparatus for emptying said fluid container using the apparatus, the method comprising:

storing, in a storage, reference data corresponding to a plurality of fluid types identifiable by an identification unit, respective fluid type information for each fluid type in the plurality of fluid types, and fluid type identifying data of fluid inside fluid containers previously coupled to the apparatus, the reference data further including a list of fluid types a pumping unit is qualified for pumping based on materials used to form the pumping unit;

performing a read-out/input of fluid type identifying data from at least one marking element of the fluid container;

receiving a current output of fluid type identifying data of the fluid container corresponding to the read-out/input of fluid type identifying data;

identifying:

a currently identified fluid type corresponding to a fluid type of the fluid inside the fluid container currently coupled to the apparatus by performing a data comparison of the fluid type identifying data with the reference data and fluid types of the fluid inside the fluid containers previously coupled to the apparatus;

determining, based on the materials used to form the pumping unit, if the pumping unit is qualified for pumping the currently identified fluid type by comparing the currently identified fluid type to:

the list of fluid types the pumping unit is qualified for pumping;

the fluid types of the fluid inside the fluid containers previously coupled to the apparatus; or both the list of fluid types the pumping unit is qualified for pumping and the fluid types of the fluid inside the fluid containers previously coupled to the apparatus;

determining how much the currently identified fluid type differs from the fluid types of the fluid inside the fluid containers previously coupled to the apparatus by comparing the currently identified fluid type to the storage of fluid type identifying data of the fluid inside fluid containers previously coupled to the apparatus;

displaying fluid type information about the currently identified fluid type, a signal of one of a number of indications when the currently identified fluid type differs from the fluid types of the fluid inside of the fluid containers previously coupled to the apparatus, or both;

beginning a pumping process if the pumping unit is qualified for pumping the currently identified fluid type and not beginning the pumping process if the pumping unit is not qualified for pumping the currently identified fluid type.

10. The method according to claim 9, performed by use of the apparatus, wherein:

the read-out/input step is performed by means of a read-out device or input section;

the identifying step is performed by means of the identification unit; and the displaying step is performed by means of a display device.

11. The method according to claim 9, comprising the further step of confirming the displayed fluid type information subsequent to the displaying step to begin the pumping process.

12. The method according to claim 9, wherein determining, based on the materials used to form the pumping unit, if the pumping unit is qualified for pumping the currently identified fluid type comprises the identification unit performing a data comparison of the fluid type identifying data with the list of fluid types the pumping unit is qualified for pumping.

13. The method of claim 1, wherein:

the data input unit of the apparatus includes an input section, wherein the current output of fluid type identifying data is provided by manually inputting the fluid type identifying data of the fluid container via the input section and/or by choosing the fluid type identifying data of the fluid container manually from a list of the reference data displayed on a display device; and determining if the pumping unit is qualified for pumping the currently identified fluid type occurs after the fluid type identifying data of the fluid container is manually input or chosen manually.

14. The method of claim 1, wherein the signal is displayed on a display device.

15. The method of claim 14, wherein the signal comprises one of three or more indications of how significantly the currently identified fluid type differs from the fluid types of the fluid inside the fluid containers previously coupled to the apparatus.

16. The method of claim 9, wherein the signal is displayed on a display device.

17. The method of claim 16, wherein the apparatus includes one of three or more indications of how significantly the currently identified fluid type differs from the fluid types of the fluid inside the fluid containers previously coupled to the apparatus and wherein the signal comprises one of the three or more indications.

18. The method of claim 1, wherein the apparatus includes three or more indications of how significantly the currently identified fluid type differs from the fluid types of the fluid inside the fluid containers previously coupled to the apparatus and wherein the signal comprises one of the three or more indications.

19. The method of claim 18, wherein the three or more indications of how significantly the currently identified fluid type differs from the fluid types of the fluid inside the fluid containers previously coupled to the apparatus includes:

a first indication that the currently identified fluid type is identical to a fluid type of the fluid inside the fluid containers previously coupled to the apparatus and a second indication that the currently identified fluid type is similar to a fluid type of the fluid inside the fluid containers previously coupled to the apparatus.

20. The method of claim 19, wherein when the signal indicates that the fluid type in the fluid container is identical to the fluid types of the fluid containers previously coupled to the apparatus, the apparatus automatically begins performing the pumping process.

* * * * *